US005778492A

United States Patent [19]

Thiessen et al.

[11] Patent Number: 5,778,492

[45] Date of Patent: Jul. 14, 1998

[54] SCRAP FIBER REFEED SYSTEM AND METHOD

[75] Inventors: Leo Kurtis Thiessen; James Sheldon Graham, both of Littleton, Colo.

[73] Assignee: Johns Manville International, Inc., Denver, Colo.

[21] Appl. No.: 856,407

[22] Filed: May 14, 1997

[51] Int. Cl.[6] ..... D01G 13/00

[52] U.S. Cl. ..... 19/107; 19/145.5

[58] Field of Search ..... 19/145, 145.5, 19/296, 303, 297, 115 B, 218, 107, 105, 66 R, 205, 97.3, 65 A, 200

[56] References Cited

U.S. PATENT DOCUMENTS

| | | | |
|---|---|---|---|
| 4,317,260 | 3/1982 | Blackburn | 19/107 |
| 4,914,787 | 4/1990 | Leifeld | 19/145 |
| 5,331,801 | 7/1994 | Heifetz | 19/145.5 |
| 5,481,864 | 1/1996 | Wright | 19/107 |

FOREIGN PATENT DOCUMENTS

| | | | |
|---|---|---|---|
| 90/12908 | 11/1990 | WIPO | 19/107 |

*Primary Examiner*—C. D. Chowder
*Assistant Examiner*—Larry O. Worrell, Jr.
*Attorney, Agent, or Firm*—Robert D. Touslee

[57] ABSTRACT

An apparatus for refeeding scrap fibers into a gaseous stream of virgin fibers and mixing the scrap fibers with the virgin fibers to form a fibrous mat includes a fiber opener for opening up and substantially eliminating scrap fiber clumps and nodules from a supply of scrap fibers by releasing scrap fibers from the clumps and nodules. The scrap fibers are conveyed by a laminar airstream from the fiber opener to a virgin fiber containing gaseous stream where the scrap fibers are mixed with the virgin fibers and the mixture of fibers is collected to form a fibrous mat. The laminar airstream for conveying the scrap fibers is preferably formed by passing the airstream through a venturi eductor to reduce turbulence and impart a more laminar flow to the airstream to reduce scrap fiber entanglement in the conveying airstream. Preferably, the scrap fibers are introduced into the conveying airstream from the fiber opener by creating a low pressure zone at an outlet of the fiber opener with the airstream which draws the scrap fibers from the fiber opener into the airstream.

24 Claims, 3 Drawing Sheets

SCRAP FIBER REFEED SYSTEM AND METHOD

BACKGROUND OF THE INVENTION

The present invention relates to a system and method for recycling scrap fibers into a manufacturing process to mix the scrap fibers with virgin fibers and form a fibrous mat product and in particular to a system and method for recycling scrap fibers which eliminates or minimizes clumps or nodules of scrap fibers from the recycled scrap fibers which would be detrimental to the fibrous product.

In manufacturing processes for producing fibrous mats, batts or blankets (hereinafter referred to as "fibrous mats") such as glass fiber or other mineral fiber manufacturing processes for producing fibrous mats, scrap fibers are generated from edge trim, product which does not meet manufacturing specifications, etc. (hereinafter referred to as "scrap fibers"). The disposal of these scrap fibers adds to the manufacturing costs of the fibrous mat product being produced in two ways. The loss of the scrap fibers rather than using the fibers to form the fibrous mat product being produced adds to the cost of the fibrous product and the disposal of the scrap fibers in a landfill or otherwise also adds to the costs of the manufacturing process. In addition, with the increasing scarcity of available landfill sites, it is desirable to minimize or eliminate the need to dispose of scrap fibers in a landfill from an environmental perspective.

Previous attempts to recycle scrap fibers in glass fiber and other mineral fiber manufacturing processes for producing fibrous mats have involved the shredding or hammermilling of the scrap fibers. The shredding or hammermilling of these scrap fibers results in the formation of clumps or nodules of scrap fibers within the scrap fibers being recycled. The shredded or hammermilled scrap fibers, including the scrap fiber clumps or nodules, are then conveyed by means of an airstream created by a material transfer fan to a location where the scrap fibers, including the scrap fiber clumps or nodules, are introduced into the fibrous product being formed by the manufacturing process.

In addition to the scrap fiber clumps or nodules formed by the shredding or hammermilling process, the turbulence created by the airstream of the material transfer fan can cause entanglement of the scrap fibers being conveyed to form addition scrap fiber clumps or nodules as the scrap fibers are conveyed to the location where the scrap fibers are introduced into the virgin fibers forming the fibrous mat being manufactured.

The introduction of the scrap fiber clumps or nodules into the fibrous mat products by the previous recycling systems and methods has frequently had a detrimental effect on the physical properties of such fibrous mat products. These scrap fiber clumps or nodules are often higher in density than the overall fiber matrix of the fibrous mat being manufactured. Accordingly, the scrap fibers in these scrap fiber clumps or nodules are not uniformly dispersed within the overall fiber matrix of the fibrous mat and contribute little, if anything, to the thermal and acoustical performance of the fibrous mat product. In addition, the resinous or similar binders generally applied to the fibers collected to form a glass fiber or other mineral fiber mat merely coat the surfaces of these scrap fiber clumps or nodules rather than penetrating the scrap fiber clumps or nodules. While coating of the surfaces of these scrap fiber clumps or nodules may be sufficient to hold the scrap fiber clumps or nodules in place within the fibrous matrix of the mat product, the presence of these scrap fiber clumps or nodules in fibrous mats, such as high density mat products, may cause these high density fibrous mat products to be "spongy" in places. Accordingly, there has been a need to provide an economical and efficient system for and method of recycling scrap fibers into these fibrous mat manufacturing processes that eliminates or greatly reduces the presence of scrap fiber clumps or nodules within the scrap fibers being recycled.

SUMMARY OF THE INVENTION

The present invention provides a solution to the above discussed problems by means of a unique system for and method of refeeding scrap fibers into a gaseous stream of virgin fibers and mixing the scrap fibers with the virgin fibers to form a fibrous mat that minimizes or greatly reduces the presence of scrap fiber clumps or nodules. In the system and method of the present invention, scrap fibers including scrap fiber clumps and nodules are passed through a fiber opener. In the fiber opener, scrap fiber clumps or nodules in the scrap fibers are broken down or opened up to release fibers from the scrap fiber clumps or nodules and substantially eliminate the scrap fiber clumps and nodules from the scrap fibers being recycled. The scrap fibers are then introduced from the fiber opener into a conveying airstream which conveys the scrap fibers from the fiber opener to a gaseous stream containing virgin fibers. The scrap fibers are introduced into gaseous stream of virgin fibers; mixed with the virgin fibers; and collected along with the virgin fibers to form a fibrous mat product.

In the system and method of the present invention, the conveying airstream for conveying the scrap fibers to mix or blend the scrap fibers with the virgin fibers has a laminar flow. In the preferred embodiment, the airstream is passed through a venturi eductor to reduce turbulence in the conveying airstream and impart a laminar flow to the conveying airstream. This greatly reduces or eliminates the formation of scrap fiber clumps or nodules, through scrap fiber entanglement or re-entanglement, as the scrap fibers are being conveyed in the conveying airstream to the gaseous stream of virgin fibers.

Preferably, the scrap fibers are introduced from the fiber opener into the conveying airstream by creating a low pressure zone with the conveying airstream at a scrap fiber discharge outlet of the fiber opener. The low pressure zone draws or sucks the scrap fibers from the scrap fiber discharge outlet of the fiber opener into the conveying airstream.

In one preferred embodiment of the present invention, the scrap fibers are passed through a heavy particle trap prior to being introduced into the fiber opening means to remove debris from the scrap fibers. It is also preferred to apply an anti-static agent to the scrap fibers prior to introducing the scrap fibers into the fiber opener to reduce the grouping of the fibers together into clumps or nodules by static charges on the fibers.

The system and method of the present invention for recycling fibers are especially suited for use in the production of glass or other mineral fibers wherein the gaseous stream of virgin fibers is from a rotary fiberization process and the scrap fibers are introduced into the gaseous stream of virgin fibers by discharging the scrap fibers from a centrally located discharge outlet beneath a fiberizing spinner used in the formation of the virgin fibers or the gaseous stream of virgin fibers is from a flame attenuation fiberizing process, such as but not limited to, a pot and marble flame attenuation fiberizing process.

DESCRIPTION OF THE PREFERRED EMBODIMENTS

Figure 1:
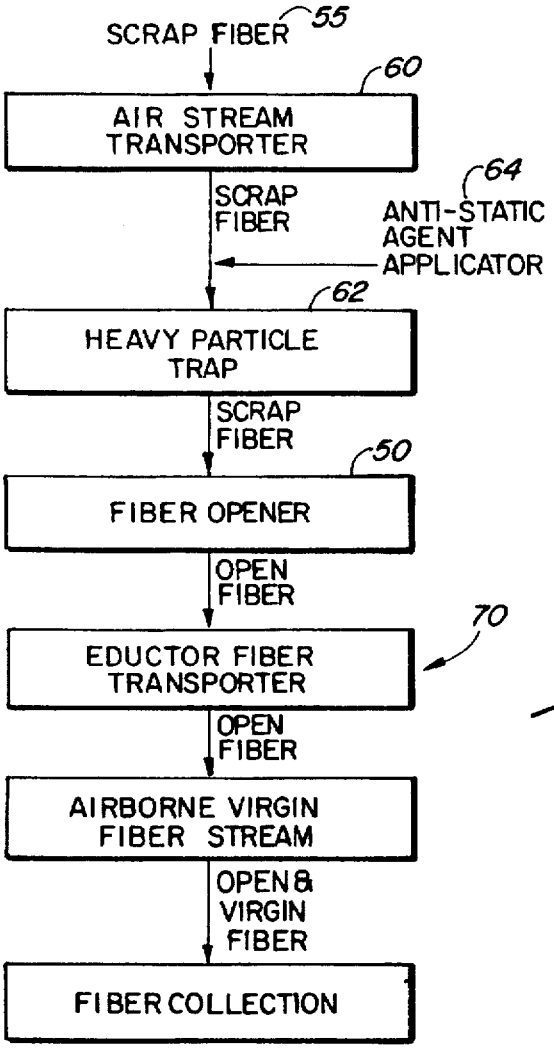
FIG. 1 is a schematic block diagram of the method for refeeding scrap fibers of the present invention.

As shown in FIG. 1 scrap fibers from a fibrous mat manufacturing process are recycled back into the fibrous mat product being produced by refeeding the scrap fibers into and mixing or blending the scrap fibers with airborne virgin fibers of the manufacturing process prior to the collection of the fibers to form the fibrous product. While the system and method of the present invention can be used in other fibrous mat manufacturing processes, the system and method of the present invention are especially suited for use in rotary and flame attenuation fiberizing processes for making mineral fiber mats, such as but not limited to glass fiber mats, as shown and described in U.S. Pat. No. 5,123,949; issued Jun. 23, 1992; to Leo K. Thiessen. The disclosure of U.S. Pat. No. 5,123,949, is hereby incorporated herein in its entirety by reference.

Figure 4:
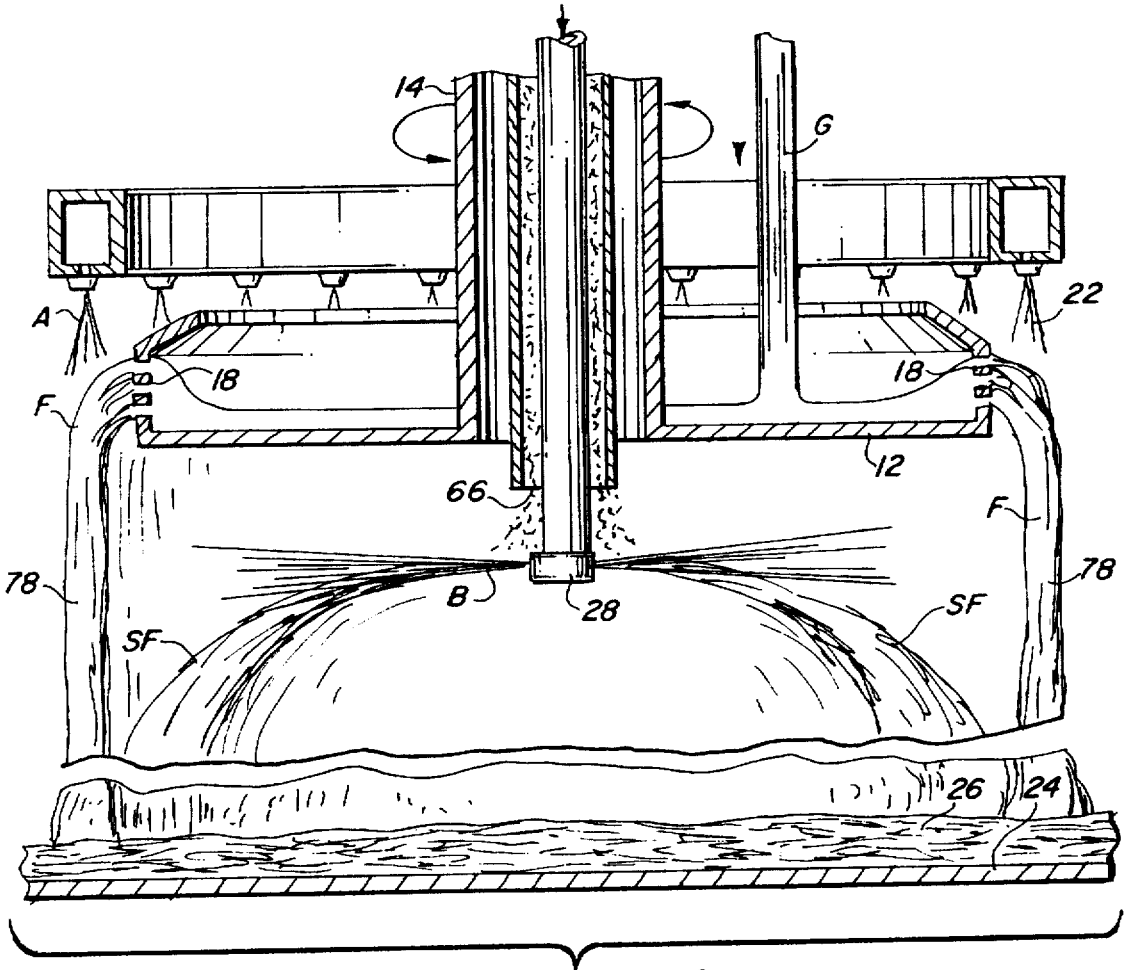
FIG. 4 is a vertical sectional view of a rotary fiberization apparatus with a means for introducing the scrap fibers into the gaseous stream of virgin fibers produced by the fiberization apparatus prior to the collection of the fibers to form a fibrous mat.

In the rotary method of forming mineral fibers, a molten mineral, such as glass G, is introduced into the rotary spinner or disk 12 of a rotary spinner assembly 10 such as the assembly shown in FIG. 4. The rotary disk 12 is connected to a rotating drive shaft 14 which is driven by a suitable drive train, not shown, and includes a sidewall 16 which contains a myriad of small holes or orifices 18. The molten mineral material such as glass G is delivered to the interior of the rotary disk 12 in a continuous stream and is directed by the centrifugal force created by the spinning disk toward the sidewall 16 where the molten mineral material is extruded through the openings 18. Normally, heating means, not shown, are provided in close proximity to the interior of the rotary disk 12 to maintain the molten mineral material within a desired temperature range. Mounted above and radially outward of the disk 12 is a tubular ring 20 containing a number of spaced nozzles 22 through which air under pressure or a flame is discharged. As the virgin fibers F exit the disk holes 18, the high pressure air streams or combustion gases A strike the virgin fibers F to further attenuate the virgin fibers and direct the virgin fibers downward toward a moving porous collection chain or conveyor 24 where the virgin fibers are collected to form the fibrous mat 26. As the virgin fibers F pass from the disk 12 down toward the collection chain or conveyor 24, a binder B is normally applied to the virgin fibers F from the spray nozzles of a binder applicator 28.

In the flame attenuation method of forming mineral fiber mats, the apparatus 30 typically includes a plurality of heated, refractory lined pots 32, containing a molten mineral material such as glass G, from which continuous primary filaments 34 are drawn by pull rolls 36 through holes 38 in the bottom of the pot. Burners 40 positioned adjacent the primary continuous filaments 34, as the primary continuous filaments exit the pull rolls 36, emit high energy flames which attenuate the primary continuous filaments 34 into smaller diameter virgin fibers F of finite length. The virgin fibers F are impelled by the high velocity gaseous streams of hot combustion gases through a forming tube 42 which directs the virgin fibers F to a porous moving collection chain or conveyor 44 where the fibers are collected to form a fibrous mat 46. A binder such as a phenolic resin binder is typically applied to the virgin fibers F by binder nozzles, such as binder nozzles 48, prior to the collection of the virgin fibers F to form the fibrous mat 46.

Suction boxes not shown are used in both the rotary and the flame attenuation processes for forming mineral fiber mats. After the fibrous mats 26 and 46 have been formed on the collection chains or conveyors, the fibrous mats are normally conveyed to a curing oven where the binder in the fibrous mats is cured.

Returning now to FIGS. 1 and 2, a supply of scrap fibers 55, including scrap fiber clumps or nodules 56, from a fibrous mat manufacturing operation are introduced into a conventional multi-roll fiber opener 50 of the type used in the textile industry, such as but not limited to a Guardian Fiber Cleaner/Opener made by Kings Mountain Textile Machinery Company, through an inlet opening 52. The fiber opener 50 includes a series of counter-rotating wire wound rolls 54 for tearing apart the scrap fiber clumps or nodules 56 and separating individual fibers from the scrap fiber clumps or nodules to convert the scrap fibers 55 from a supply of scrap fibers which includes scrap fiber clumps or nodules 56 to a refined or opened supply of essentially "individualized" scrap fibers where the number of scrap fiber clumps or nodules are greatly reduced or eliminated. The wire wound rolls 54 may be described as analogous to a metal cylinder circumferentially wrapped with a "band saw blade". The configurations of the wire blades covering the rolls 54, e.g. the number of circumferential wire teeth per linear inch and the height of the wire teeth above the cylinder surface, as well as the rotational speed of the rolls 54 relative to adjacent rolls and the spacing between the wire teeth of the adjacent rolls, are set to tear apart the scrap fiber clumps or nodules passing between the adjacent rolls 54 to open up or refine and individualize the scrap fibers delivered to the opened or refined fiber outlet 58 of the fiber opener.

Preferably, as shown in FIG. 1, the supply of scrap fibers 55, including the scrap fiber clumps or nodules 56 are conveyed by an airstream 60 through a heavy particle trap 62 and/or an anti-static agent applicator 64. The heavy particle trap 62 is a conventional, commercially available heavy particle trap, such as but not limited to, a heavy particle trap made by Kings Mountain Textile Machinery Company, which by producing a velocity drop in the scrap fiber conveying airstream 60 within the ductwork system conveying the scrap fibers to the fiber opener 50 allows any heavy debris which may be present within the scrap fiber supply to fall out of the airstream 60 into a collection chamber or unit for disposal. In the present application, the scrap fiber supply 55, in addition to other debris, may include scrap fiber clumps or nodules with wet binder that could clog or foul up the wire teeth of the wire rolls 54 in the fiber opener 50. Due to their weight, these wet scrap fiber clumps or nodules fall out of the airstream along with other unwanted debris.

The anti-static agent applicator 64 includes a series of conventional spray nozzles, not shown, which distribute an atomized spray of an anti-static agent onto the scrap fibers in the airstream 60 as the scrap fibers are conveyed through the ductwork system to the fiber opener 50. Any number of commercially available anti-static agents may be used, such as but not limited to, LAROSTAT 264A anti-static agent sold by PPG industries. By applying an anti-static agent to the scrap fibers, static charges are not generated on the scrap fibers which would cause the scrap fibers to cling together. While the anti-static agent applicator 64 is shown located in the ductwork system upstream of the heavy particle trap 62, it may also be located in the ductwork system downstream of the heavy particle trap 62.

Figure 3:
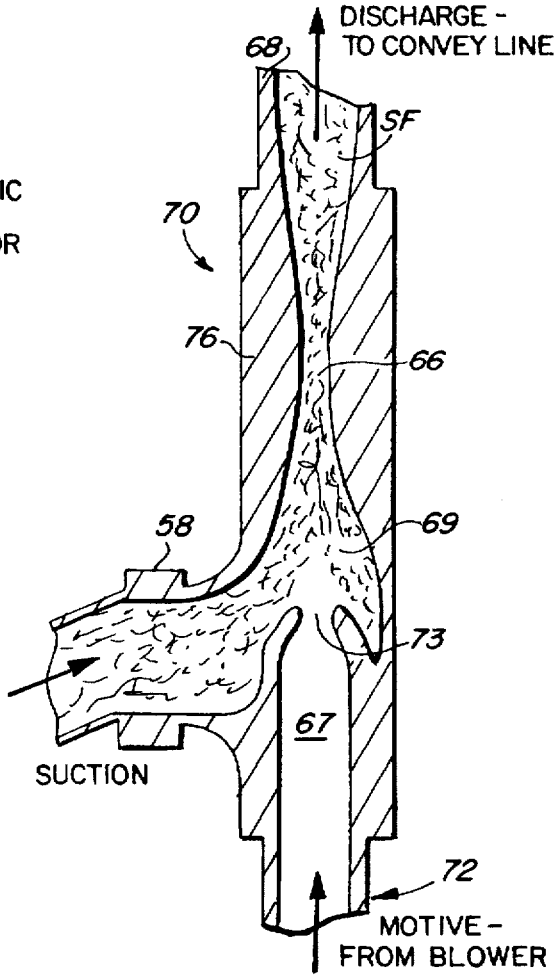
FIG. 3 is an enlarged schematic sectional view of the venturi eductor used in the scrap fiber conveying system of FIG. 2.
Figure 2:
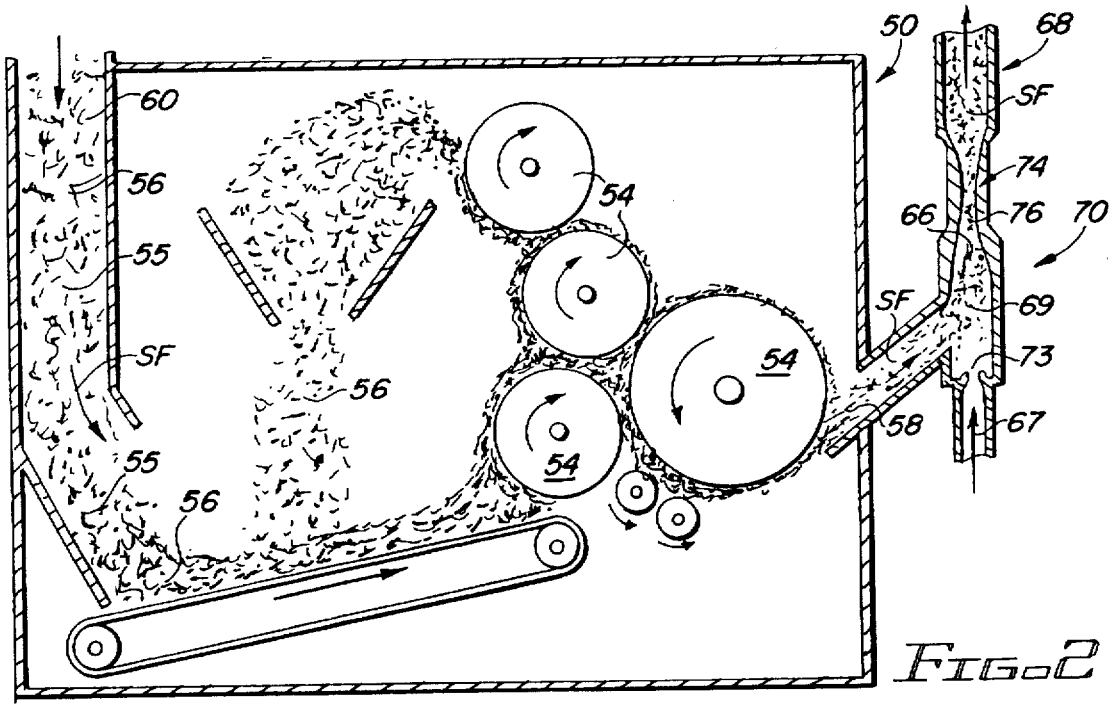
FIG. 2 is a schematic diagram of a fiber opener and the airstream conveying system with a venturi eductor for conveying the scrap fibers from the fiber opener to the gaseous stream of virgin fibers.

As best shown in FIGS. 2 and 3, the refined or opened scrap fibers SF are discharged from the fiber opener 50 and conveyed to the airborne stream of virgin fibers by a conveying airstream 66 within a ductwork system 68. Preferably, the scrap fibers SF are introduced from the fiber opener 50 into the conveying airstream 66 by creating a low pressure zone 69 with the conveying airstream 66 at a scrap fiber discharge outlet 58 of the fiber opener. The low pressure zone 69 within the ductwork system 68 draws or sucks the scrap fibers SF from the scrap fiber discharge outlet 58 of the fiber opener 50 into the conveying airstream 66. As shown, the low pressure zone 69 is created by a venturi eductor 70 which has a motive air nozzle 72 with a reduced cross section at its outlet 73 to generate a high velocity conveying airstream 66 from a motive airstream 67. When the conveying airstream 66 passes through the venturi portion 76 (the reduced cross section portion) of the eductor 70, the velocity of the airstream 66 is further increased and the low pressure (suction) zone 69 is generated within the eductor inlet at the outlet 58 of the fiber opener 50. The venturi portion 76 of the eductor 70 also imparts a laminar flow to the conveying airstream 66, with the scrap fibers SF entrained therein, so that the scrap fibers SF in the conveying airstream 66 do not become entangled or re-entangled to form scrap fiber clumps or nodules prior to being introduced into the gaseous stream of virgin fibers 78. Since the venturi eductor 70 substantially eliminates or greatly reduces the turbulence within the motive airstream 67 to form the laminar conveying airstream 66 so that the scrap fibers SF conveyed by the conveying airstream 66 do not become entangled or re-entangled to form clumps or nodules, the motive airstream 67 may be generated by a blower or other means.

Figure 5:
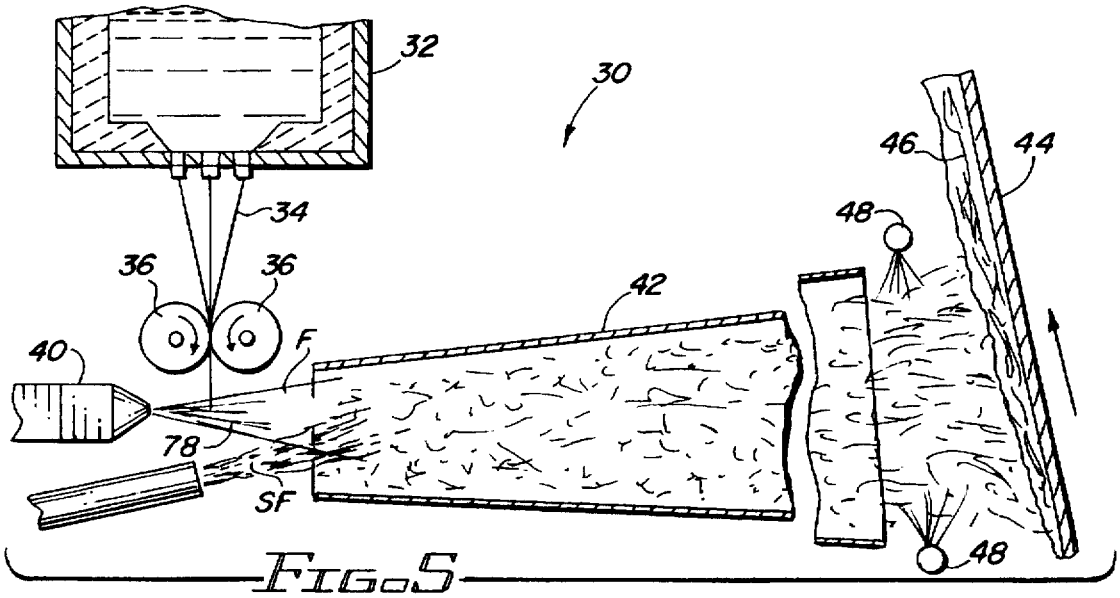
FIG. 5 is a vertical sectional view of a flame attenuation apparatus with a means for introducing the scrap fibers into the gaseous stream of virgin fibers produced by the flame attenuation apparatus prior to the collection of the fibers to form a fibrous mat.
Figure 6:
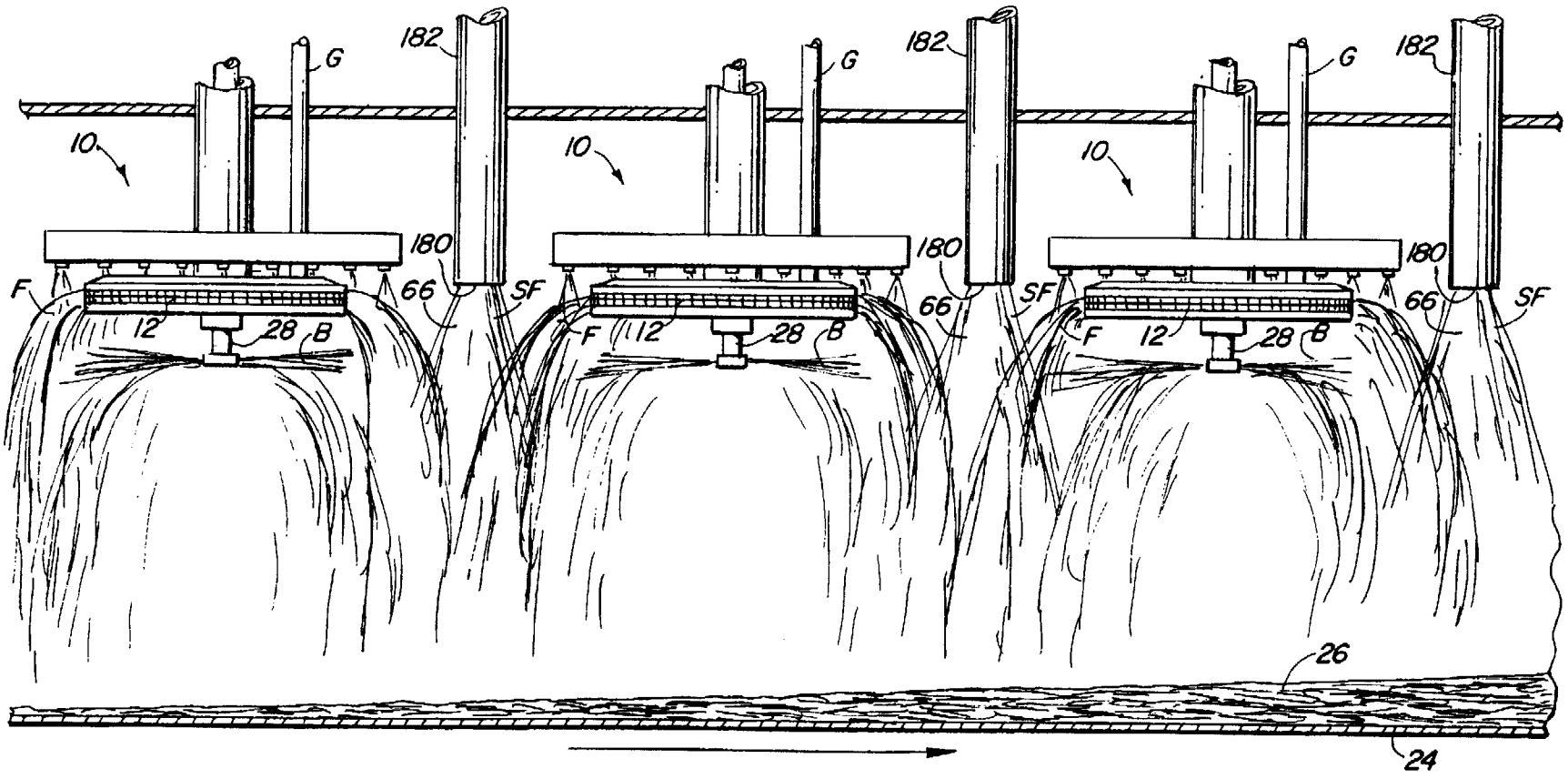
FIG. 6 is a schematic vertical longitudinal section of a fiberization chamber with a plurality of rotary spinner assemblies for producing virgin fibers and means intermediate the rotary spinner assemblies for introducing scrap fibers into the gaseous steams of virgin fibers prior to the collection of the fibers to form a fibrous mat.

As shown in FIGS. 4, 5 and 6, the scrap fibers SF are introduced into and mixed or blended with the airborne virgin fibers F in the gaseous streams coming from the fiberizers in the rotary or flame attenuation processes to form fibrous mats.

In the rotary process of FIG. 4, the scrap fibers SF are discharged by the conveying airstream 66 from the open end 80 of a centrally located tube 82 beneath the rotating disk 12 the rotary fiberization assembly 10 into the gaseous stream of virgin fibers made by the rotary fiberization assembly 10. The scrap fibers SF are distributed throughout the gaseous stream of virgin fibers F, where desired a binder is applied to the mixture or blend of fibers, and the mixture or blend of scrap and virgin fibers is collected on the foraminous collection chain 24 to form the fibrous mat 26. Preferably, there is a discharge tube 82 associated with each rotary fiberization assembly 10 in the collection chamber to introduce scrap fibers SF into each stream of virgin fibers F.

In the flame attenuation process of FIG. 5, the scrap fibers SF are discharged by the conveying airstream 66 from the open end 84 of tube 86 located directly beneath the burner 40 of the flame attenuation apparatus 30. Preferably, a discharge tube 84 is located beneath each burner 40 of the flame attenuation apparatus 30. The scrap fibers SF are distributed throughout the gaseous stream of virgin fibers F, where desired a binder B is applied to the mixture or blend of fibers, and the mixture or blend of scrap and virgin fibers is collected on the foraminous collection chain 44 to form the fibrous mat 46.

In the rotary process of FIG. 6, the scrap fibers SF are discharged by the conveying airstreams 66 from the open ends 180 of tubes 182, located intermediate the rotating disks 12 of the rotary fiberization assemblies 10, into the gaseous streams of virgin fibers F made by the rotary fiberization assemblies 10. In addition, the scrap fibers SF can also be introduced into the collection chamber immediately downstream of the last rotary fiberization assembly 10 provided the scrap fibers SF are thoroughly mixed with the virgin fibers F made by the rotary fiberization assemblies 10. The scrap fibers SF are distributed throughout the gaseous stream of virgin fibers F, where desired a binder B is applied to the mixture or blend of fibers by binder applicators 28, and the mixture or blend of scrap and virgin fibers is collected on the foraminous collection chain 24 to form the fibrous mat 26.

In describing the invention, certain embodiments have been used to illustrate the invention and the practices thereof. However, the invention is not limited to these specific embodiments as other embodiments and modifications within the spirit of the invention will readily occur to those skilled in the art on reading this specification. Thus, the invention is not intended to be limited to the specific embodiments disclosed, but is to be limited only by the claims appended hereto.

What is claimed is:

1. A method of refeeding scrap fibers into a gaseous stream of virgin fibers and mixing the scrap fibers with the virgin fibers to form a fibrous mat, comprising:

introducing scrap fibers including scrap fiber clumps and nodules into a fiber opening means; passing the scrap fibers through the fiber opening means to open up and substantially eliminate the scrap fiber clumps and nodules from the scrap fibers by releasing scrap fibers from the clumps and nodules;

introducing the scrap fibers from the fiber opening means into a conveying airstream and conveying the scrap fibers from the fiber opening means to a virgin fiber containing gaseous stream by means of the conveying airstream which is passed through a venturi eductor means to reduce turbulence in the conveying airstream and impart a more laminar flow to the conveying airstream to reduce scrap fiber entanglement in the conveying airstream;

introducing the scrap fibers into the gaseous stream of virgin fibers and mixing the scrap fibers with the virgin fibers; and collecting the mixture of virgin and scrap fibers to form a fibrous mat.

2. The method of refeeding and mixing scrap fibers according to claim 1, wherein: the scrap fibers are introduced from the fiber opening means into the conveying airstream by creating a low pressure zone with the conveying airstream at a scrap fiber discharge outlet of the fiber opening means which draws the scrap fibers from the scrap fiber discharge outlet into the conveying airstream.

3. The method of refeeding and mixing scrap fibers according to claim 1, including: passing the scrap fibers through a heavy particle trap prior to introducing the scrap fibers into the fiber opening means to remove debris from the scrap fibers.

4. The method of refeeding and mixing scrap fibers according to claim 1, including: applying an anti-static agent to the scrap fibers prior to introducing the scrap fibers into the fiber opening means.

5. The method of refeeding and mixing scrap fibers according to claim 1, wherein: the gaseous stream of virgin fibers is from a rotary fiberization process and the scrap fibers are introduced into the gaseous stream of virgin fibers by discharging the scrap fibers from a centrally located discharge outlet beneath a fiberizing spinner used in the formation of the virgin fibers.

6. The method of refeeding and mixing scrap fibers according to claim 1, wherein: the gaseous stream of virgin fibers is from a flame attenuation process.

7. The method of refeeding and mixing scrap fibers according to claim 1, wherein: there are at least two gaseous streams of virgin fibers produced by at least two fiberizing spinners and the scrap fibers are discharged into the plurality of gaseous streams of virgin fibers from a discharge outlet located intermediate the two fiberizing spinners.

8. The method of refeeding and mixing scrap fibers according to claim 2, including: passing the scrap fibers through a heavy particle trap prior to introducing the scrap fibers into the fiber opening means to remove debris from the scrap fibers.

9. The method of refeeding and mixing scrap fibers according to claim 8, including: applying an anti-static agent to the scrap fibers prior to introducing the scrap fibers into the fiber opening means.

10. The method of refeeding and mixing scrap fibers according to claim 9, wherein: the gaseous stream of virgin fibers is from a rotary fiberization process and the scrap fibers are introduced into the gaseous stream of virgin fibers by discharging the scrap fibers from a centrally located discharge outlet beneath a fiberizing spinner used in the formation of the virgin fibers.

11. The method of refeeding and mixing scrap fibers according to claim 9, wherein: the gaseous stream of virgin fibers is from a flame attenuation process.

12. The method of refeeding and mixing scrap fibers according to claim 9, wherein: there are at least two gaseous streams of virgin fibers produced by at least two fiberizing spinners and the scrap fibers are discharged into the plurality of gaseous streams of virgin fibers from a discharge outlet located intermediate the two fiberizing spinners.

13. An apparatus for refeeding scrap fibers into a gaseous stream of virgin fibers and mixing the scrap fibers with the virgin fibers to form a fibrous mat, comprising:

a fiber opening means for opening up and substantially eliminating scrap fiber clumps and nodules from a supply of scrap fibers by releasing scrap fibers from the clumps and nodules;

a conveying airstream for conveying the scrap fibers from the fiber opening means to a virgin fiber containing gaseous stream; a venturi eductor means through which the conveying airstream is passed to reduce turbulence in the conveying airstream and impart a more laminar flow to the conveying airstream to reduce scrap fiber entanglement in the conveying airstream;

means for introducing the scrap fibers from the fiber opening means into the conveying airstream;

means for introducing the scrap fibers into the gaseous stream of virgin fibers and mixing the scrap fibers with the virgin fibers; and means for collecting the mixture of virgin and scrap fibers to form a fibrous mat.

14. The apparatus for refeeding and mixing scrap fibers according to claim 13, wherein: the means for introducing the scrap fibers from the fiber opening means into the conveying airstream includes means for creating a low pressure zone with the conveying airstream at a scrap fiber discharge outlet of the fiber opening means which draws the scrap fibers from the scrap fiber discharge outlet into the conveying airstream.

15. The apparatus for refeeding and mixing scrap fibers according to claim 13, including: means for introducing the scrap fibers into the fiber opening means which includes a heavy particle trap for removing debris from the scrap fibers.

16. The apparatus for refeeding and mixing scrap fibers according to claim 13, including: means for applying an anti-static agent to the scrap fibers prior to introducing the scrap fibers into the fiber opening means.

17. The apparatus for refeeding and mixing scrap fibers according to claim 13, wherein: the gaseous stream of virgin fibers is from a rotary fiberization process and the scrap fibers are introduced into the gaseous stream of virgin fibers by discharging the scrap fibers from a centrally located discharge outlet beneath a fiberizing spinner used in the formation of the virgin fibers.

18. The apparatus for ref eeding and mixing scrap fibers according to claim 13, wherein: the gaseous stream of virgin fibers is from a flame attenuation process.

19. The apparatus for refeeding and mixing scrap fibers according to claim 13, wherein: there are at least two fiberizing spinners producing at least two gaseous streams of virgin fibers and the means for introducing the scrap fibers into the gaseous stream of virgin fibers and mixing the scrap fibers with the virgin fibers is located intermediate the two fiberizing spinners and discharges the scrap fibers into the two gaseous streams of virgin fibers.

20. The apparatus for refeeding and mixing scrap fibers according to claim 14, including: means for introducing the scrap fibers into the fiber opening means which includes a heavy particle trap for removing debris from the scrap fibers.

21. The apparatus for refeeding and mixing scrap fibers according to claim 20, including: means for applying an anti-static agent to the scrap fibers prior to introducing the scrap fibers into the fiber opening means.

22. The apparatus for refeeding and mixing scrap fibers according to claim 21, wherein: the gaseous stream of virgin fibers is from a rotary fiberization process and the scrap fibers are introduced into the gaseous stream of virgin fibers by discharging the scrap fibers from a centrally located discharge outlet beneath a fiberizing spinner used in the formation of the virgin fibers.

23. The apparatus for refeeding and mixing scrap fibers according to claim 21, wherein: the gaseous stream of virgin fibers is from a flame attenuation process.

24. The apparatus for refeeding and mixing scrap fibers according to claim 21, wherein: there are at least two fiberizing spinners producing at least two gaseous streams of virgin fibers and the means for introducing the scrap fibers into the gaseous stream of virgin fibers and mixing the scrap fibers with the virgin fibers is located intermediate the two fiberizing spinners and discharges the scrap fibers into the two gaseous streams of virgin fibers.

* * * * *